United States Patent [19]

Bayer et al.

[11] Patent Number: 4,739,828

[45] Date of Patent: Apr. 26, 1988

[54] HEAT EXCHANGER

[75] Inventors: Juergen Bayer, Esslingen; Karl E. Hummel, Bietigheim, both of Fed. Rep. of Germany

[73] Assignee: Sueddeutsche Kuehlerfabrik Julius Fr. Behr GmbH. & Co. KG, Stuttgart, Fed. Rep. of Germany

[21] Appl. No.: 905,303

[22] Filed: Sep. 9, 1986

[30] Foreign Application Priority Data

Sep. 12, 1985 [DE] Fed. Rep. of Germany ..... 3532493
Jun. 7, 1986 [DE] Fed. Rep. of Germany ..... 3619265
Jun. 7, 1986 [DE] Fed. Rep. of Germany ..... 3619267

[51] Int. Cl.[4] ..... F28F 9/02

[52] U.S. Cl. ..... 165/173; 165/175; 285/331

[58] Field of Search ..... 165/173, 175; 285/331, 285/200; 29/157.4

[56] References Cited

U.S. PATENT DOCUMENTS 2,164,628 7/1939 Sibley ..... 165/173 X
2,561,827 7/1951 Soos ..... 285/331 X
4,052,990 10/1977 Dodgson ..... 285/331 X
4,256,333 3/1981 Jones ..... 285/331 X
4,495,987 1/1985 Finnan ..... 165/173 X
4,508,374 4/1985 Kantor ..... 285/331 X
4,585,255 4/1986 Ridenour ..... 285/331 X
4,586,566 5/1986 Kern et al. ..... 165/173

FOREIGN PATENT DOCUMENTS 2036398 7/1970 Fed. Rep. of Germany ..... 165/173
3308349 8/1985 Fed. Rep. of Germany .

*Primary Examiner*—Albert W. Davis, Jr.
*Assistant Examiner*—Richard R. Cole
*Attorney, Agent, or Firm*—Schwartz, Jeffery, Schwaab, Mack, Blumenthal & Evans

[57] ABSTRACT

Disclosed is a heat exchanger, comprising a tube sheet comprised of plastic and having at least one opening for passage of a heat exchange fluid; and a heat exchanger tube sealed against the tube sheet at the opening, wherein the tube sheet includes in the region of each of the openings a sleeve-like connection nozzle in which an annular groove is defined by inner and outer parts of said nozzle. The groove extends coaxially to the opening and is open toward the heat exchanger tube and the end of the heat exchanger tube is pressed into the groove. The sleeve-like connection nozzles have a middle section (B), which is located in the plane of the tube sheet, and end sections, (A, C) which project on either side of the tube sheet.

23 Claims, 6 Drawing Sheets

Fig. 1a
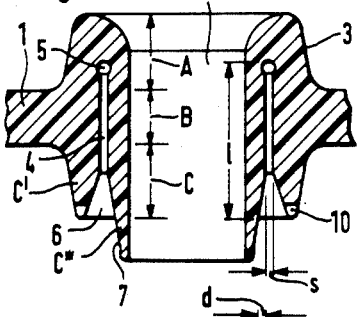
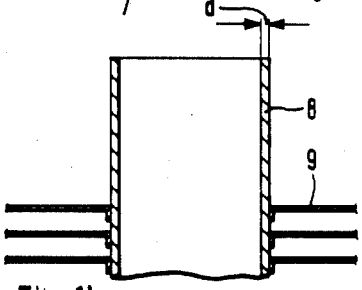
Fig. 1b
Fig. 2a
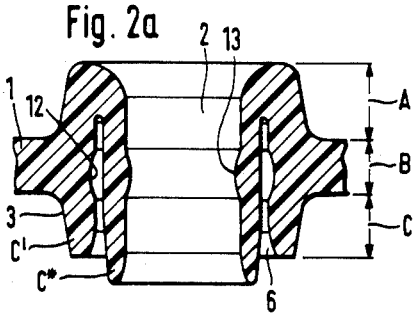
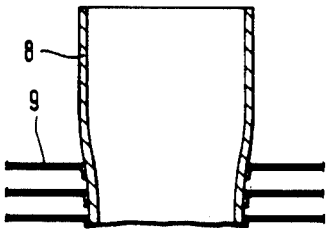
Fig. 2b
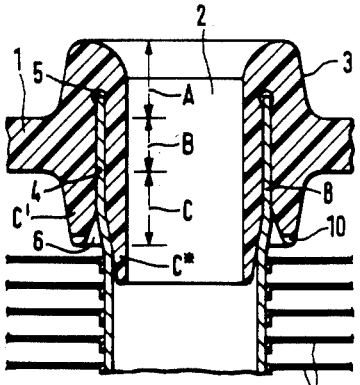
Fig. 1c
Fig. 2c
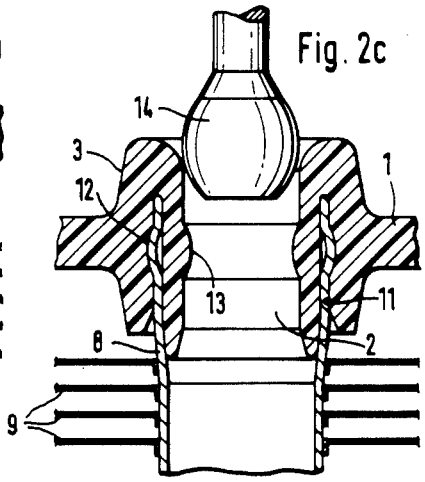

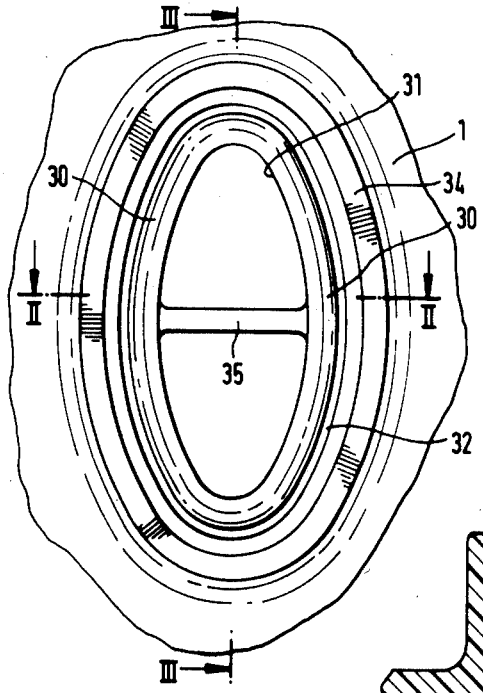
FIG. 6
FIG. 7
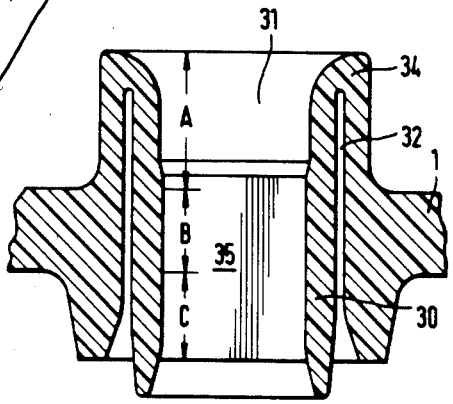
FIG. 8
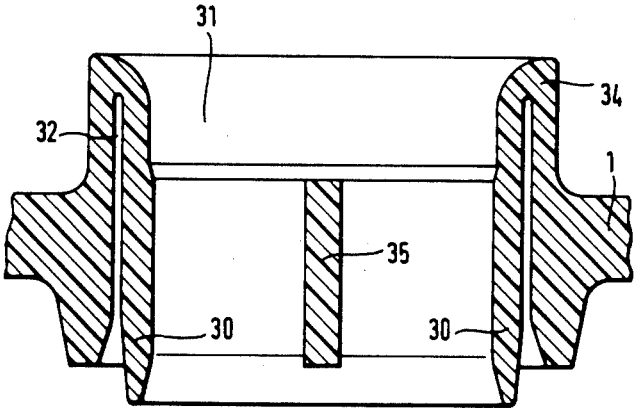

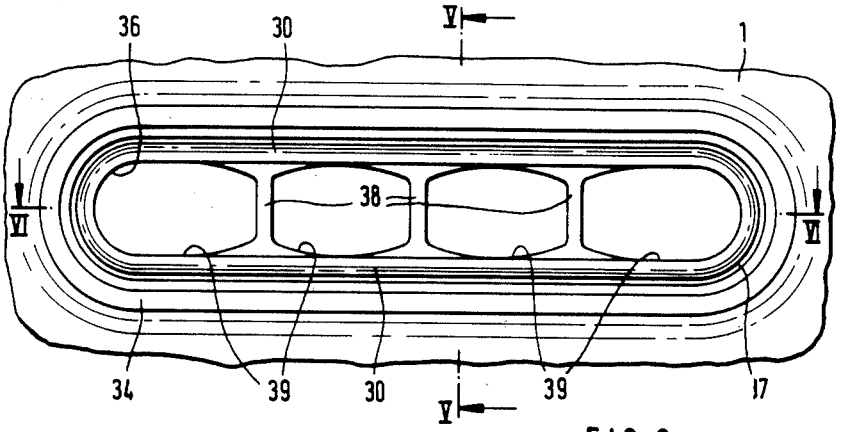
FIG. 9
FIG. 11
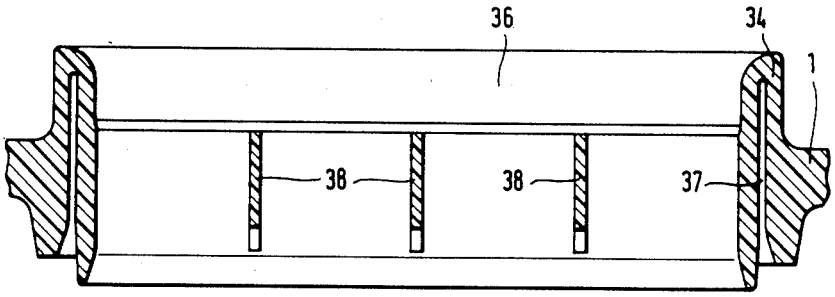
FIG. 10
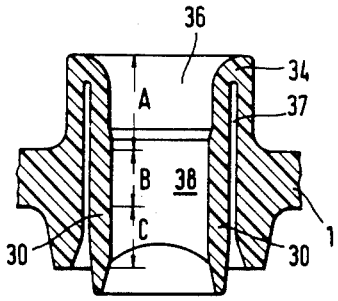

HEAT EXCHANGER

BACKGROUND OF THE INVENTION

The present invention relates to a heat exchanger of the type having a plastic header sheet including a sleeve-like connection nozzle associated with each tube opening for insertion into each tube and an annular groove extending coaxially to the opening for receiving the tube end inserted therein. A heat exchanger of this type is disclosed in German Offenlegungsschrift No. 3,133,665. In the known arrangement, the connection nozzle is located on that side of the header sheet which faces the heat exchanger block. This has the consequence, however, that a great deal of space is required between the tube sheet and the fin block for the connection nozzles and, for strength reasons, the connection nozzle part located radially outside the tube must be made relatively thick. Furthermore, for reasons of injection-molding technology, the long projecting end of the connection nozzles is also unfavorable, since it does not allow the injection mold to be filled uniformly.

SUMMARY OF THE INVENTION

It is therefore an object of the present invention to provide an improved heat exchanger of the generic type described above.

It is also an object of the invention to provide such a heat exchanger in which, by the arrangement of the connection nozzle, a smaller installation space is achieved.

Still another object of the invention resides in providing a heat exchanger exhibiting a more favorable force distribution in the junction zone between tube sheet and tube.

In accomplishing the foregoing objects, there has been provided according to the present invention a heat exchanger, comprising a tube sheet comprised of plastic and having at least one opening for passage of a heat exchange fluid; and a heat exchanger tube sealed against the tube sheet at the opening, wherein the tube sheet includes in the region of each of the openings a sleeve-like connection nozzle in which an annular groove is defined by inner and outer parts of the nozzle. The groove extends coaxially to the opening and is open toward the heat exchanger tube and into it the end of the heat exchanger tube is pressed. The sleeve-like connection nozzles have a middle section (R), which is located in the plane of the tube sheet, and end sections (A, C) which project on either side of the tube sheet.

Further objects, features and advantages of the present invention will become apparent from the detailed description of preferred embodiments which follows, when considered together with the attached figures of drawings.

BRIEF DESCRIPTION OF THE DRAWINGS

In the drawings:

FIGS. 1*a*–1*c* show a detail of a tube sheet in cross-section, with a connection nozzle before and after the tube end is pressed into the tube sheet;

FIGS. 2*a*–2*c* show a variant of FIGS. 1*a*–1*c;*

FIG. 6 shows a detail of a tube sheet with an oval opening for connection of an oval tube;

FIG. 7 shows a section along line II—II in FIG. 6;

FIG. 8 shows a section along line III—III in FIG. 6;

FIG. 9 shows a detail of a tube sheet with a connection nozzle for a flat tube;

FIG. 10 shows a section along line V—V in FIG. 9; and

FIG. 11 shows a section along line VI—VI in FIG. 9.

DETAILED DESCRIPTION OF THE PREFERRED EMBODIMENTS

Figure 3:
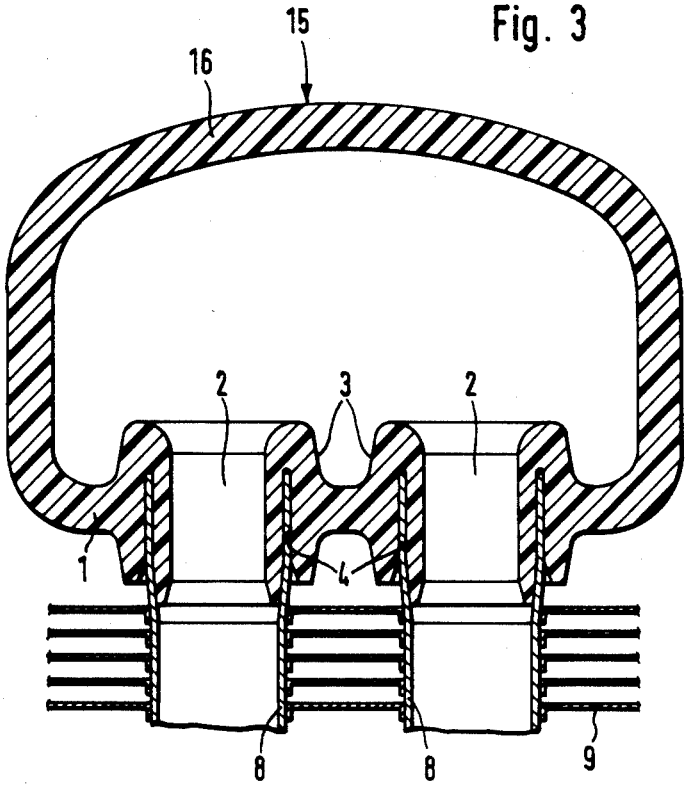
FIG. 3 shows a section through a header box of a heat exchanger with heat exchanger tubes pressed into the tube sheet.

The essential advantages of the solution according to the invention are to be seen not only in the reduced installation space in the region between the tube sheet and fin block and in a more uniform force distribution in the junction zone, but additionally in that a more favorable mass distribution of the tube sheet is obtained, which leads to more uniform filling in the injection-molding of the tube sheet and to a lower material consumption. The uniform mass distribution of the material on either side of the tube sheet plane guarantees that the tube sheet is free of distortion, that is to say without curvature, even longitudinally. A further advantage is that a non-positive connection is obtained, the mechanical strength and leak-tightness of which are particularly high, since a frictional connection with high compression results on both the inside and the outside of the tube. It is also of great importance that the connection arrangement is reliably leak-tight without additional sealant.

The axial length of the individual sections of the connection nozzle is variable and can be sized in accordance with requirements. For motor vehicle heat exchangers, a division of the total length into the three sections within the following limits has proven to be particularly advantageous:

A=30% to 50%

B=20% to 35%

C=25% to 40%.

Furthermore, it is advantageous for that part of the connection nozzle which is located radially inside the heat exchanger tube to be longer than the part located radially outside the heat exchanger tube. In this way, not only is the contact surface between tube and tube nozzle lengthened, but the tube is also gradually widened when the tip of the part protruding into the tube has a conical design. The widening of the tube end as compared with the original diameter has the advantage that the change in cross-section in the transition region from the connection nozzle to the tube is minimized.

In order to obtain the largest possible pressing area between the connection nozzle and the tube, it is proposed that the depth of the annular groove should be about 65% to 90% of the axial length of the connection nozzle. If no further measures are provided for increasing the frictional connection, it is advantageous to make the wall parts of the annular groove cylindrical over almost the entire axial length.

To improve the frictional connection between the tube and connection nozzle, the radial curvature can be provided in the wall of the annular groove, which curvature preferably protrudes into the annular groove and constricts the latter. The result of this curvature, protruding into the annular groove and constricting the latter, in the region of the end section on the inside of the water compartment is that, when the tube is pressed in, the tube end strikes the curvature, and the frictional or clamping forces prevent further penetration of the tube end into the annular groove. When the tube end is then in contact with the annular groove of one tube sheet, but the opposite end is not yet in contact with the second tube sheet, the pressing-in process is continued, with unchanged application of force, only at that tube end which has not yet reached the curvature in the annular groove. Due to the existing tolerances in the tube lengths, which are unavoidable in the mass production of heat exchangers, pressing-in up to the bottom of the groove would have the consequence that the plastic material would tear due to the notching effect.

According to an advantageous embodiment, two curvatures are provided, wherein the first curvature, which constricts the annular groove, is located nearer to the bottom of the groove than a second curvature, which widens the annular groove. This arrangement has the advantage that, in the case of tubes having a length in the upper tolerance range, so that the shear force arising in the plastic material could become unduly large, that part of the section A which is located radially outside the tube end is able, due to the second curvature, to extend radially once the tube end has passed the first curvature.

Preferably, the first and the second curvature are arranged on the same side of the wall part of the annular groove and, as viewed in the axial direction, in immediate succession. In a further embodiment, the curvatures are arranged on the radially outer wall part of the annular groove.

To prevent the tube, when pressed into the annular groove, from being "braked" too early before the bottom of the groove, it is advantageous to arrange the first curvature at a distance from the bottom of the groove which is at least three times, preferably five times, the width of the annular groove. This distance provides a sufficient safety margin for preventing tearing of the plastic material at the bottom of the groove due to a notching effect.

In order to prevent tearing of the material in the region of the bottom of the annular groove due to a notching effect, it is advantageous to provide a widening, which needs to be only slight, at the bottom of the groove. As tests have shown, it is appropriate for the width of the annular groove to be about 50% to 70% of the tube wall thickness.

It is also to be regarded as an essential advantage of the invention that the shape of the openings, and of the grooves surrounding the openings, can be selected in accordance with the particular shape of tube. A deformation of the wall parts, which extend in the direction of the longer axis, radially within the annular groove in the direction of the opening is reliably prevented by the web or webs.

In an advantageous design of this embodiment, the openings have the cross-sectional shape of a flat tube. With such a shape of the openings, it is advantageous to provide two or more webs, preferably three webs. Furthermore, in the case of wall parts extending parallel to one another, it is appropriate to make the inner wall surfaces of the openings between the webs or on the flat sides concave.

According to a further embodiment, the openings have the cross-sectional shape of an oval tube. For adequate support of the wall parts by means of the webs, it is proposed that the webs, as viewed in the axial direction of the openings, extend over 50% to 80% of the total length of the sections of the connection nozzle and are located mainly in the middle section and in the section located on the outside of the tube sheet. The face directed against the flow of the fluid can have a flat, curved or pointed shape.

Since pressing of the heat exchanger tubes into the annular grooves of the connection nozzles leads to a mechanically extremely strong and very leak-tight connection, this arrangement is also suitable for heat exchangers in which the complete water compartment including the tube sheet consists of a single part. Illustrative examples of the heat exchanger according to the invention are described in more detail below by reference to the drawings.

FIG. 1 shows a detail of a tube sheet 1 which has an opening 2 for letting heat exchange fluid pass through. The tube sheet 1 has a connection nozzle 3 which surrounds the opening 2 and comprises a middle section B, an end section A protruding into the interior of the header box or compartment and a section C located on the outside of the tube sheet 1. In the sleeve-shaped connection nozzle 3, there is an annular groove 4 which is arranged coaxially to the opening 2 and which reaches, starting from section C, as far as section A. At the bottom of the annular groove 4, a widening 5 is provided between the wall parts of the annular groove 4, this widening being only slight and having the purpose of avoiding notching effects due to the heat exchanger tube being pressed in. The annular groove 4 is of such a shape that its wall parts are cylindrical over the major part of the axial length, and a conical widening 6 is provided at the open end of the annular groove. The width of the annular groove in the region of the cylindrical wall parts is marked s. The end section C of the connection nozzle 3 has a radially outer part C′ and a radially inner part C*, the part C* having a greater axial length than the part C′ and being provided at its end with a cone 7.

At the outer end of the part C′ of the section C, several recesses 10 are provided, which are distributed around the circumference and which facilitate a later introduction of a sealant in the event of a repair of the heat exchanger. The depth of the annular groove 4 is marked 1.

FIG. 1*b* shows the end of a heat exchanger tube 8, which is fitted with a multiplicity of transversely extending fins 9. The tube wall thickness of the heat exchanger tube 8 is marked d. When the heat exchanger tube 8 is pressed into the annular groove 4, the end of the heat exchanger tube first strikes the cone 7 of the inner part C* of the section C and is slightly widened by the cone 7. When the heat exchanger tube 8 is pressed further into the annular groove 4, the annular groove is somewhat widened because of the greater tube wall thickness d as compared with the gap s of the annular groove 4, so that large radial forces between the wall parts of the material in the connection nozzle 3 and the heat exchanger tube 8 result. This produces a connection arrangement of heat exchanger tubes to a tube sheet which withstands high mechanical stresses and furthermore guarantees highly reliable leak-tightness. Since both the inner wall and the outer wall of the tube serve for sealing, temperature changes have no adverse effect on the leak-tightness of the connection.

The tube wall thickness d must, of course, be greater than the width s of the annular groove, the approximate ratio being, for example, $$\frac{d}{s} = \frac{1.5}{1} \text{ to } \frac{2}{1}$$

FIG. 1*c* shows the arrangement with the heat exchanger tube 8 pressed into the tube sheet 1. The reference symbols are the same as those in FIGS. 1*a* and 1*b* for identical parts. As this illustration shows, that part of the heat exchanger tube 8 which is located in the annular groove 4 is slightly widened as compared with the original diameter, and this has the advantage that the change in the cross-section at the transition from the opening 2 to the tube 8 is minimized. As can also be seen from FIGS. 1*a* and 1*c*, section B of the connection nozzle 3 corresponds to the thickness of the tube sheet 1.

FIG. 2*a* also shows a detail of a tube sheet 1 with an opening 2 and a connection nozzle 3 surrounding the opening. The connection nozzle 3 again comprises the sections A, B and C, as already described in FIG. *1a*. In the connection nozzle 3, an annular groove 11 is provided which likewise terminates in a conical opening 6 and, in addition, there is a radially outwardly directed curvature 12 on the radially outer wall of the annular groove 11 in the region of the section B. The radially inner wall part of the annular groove 11 is of cylindrical shape. The opening 2 has, on its wall, an inwardly-directed radial curvature 13, as a result of which there is a thickening of the part of section B located inside the heat exchanger tube 8. In shape and position, this curvature 13 corresponds to curvature 12, and its purpose is described below with reference to FIG. 2*c*.

FIG. 2*b* shows the end of a heat exchanger tube 8 which has already been widened, as compared with the original tube diameter, before being pressed into the annular groove 11 of the tube sheet 1.

FIG. 2*c* gives a view of the finished connection arrangement. The reference symbols are the same as in FIGS. 2*a* and 2*b*. The heat exchanger tube 8 has been pressed into the annular groove 11. After pressing-in, both the plastic material of the connection nozzle 3 and the end of the heat exchanger tube 8 have been radially widened by means of a widening mandrel 14, with an elastic redeformation also taking place due to the material properties of the plastic. As a result of the curvature 13, a more extensive deformation of the heat exchanger tube 8 occurs in this region, so that the tube comes to bear against the radial curvature 12 of the annular groove 11. In this way, in addition to the pressing force between the tube sheet and the heat exchanger tube, a positive connection is produced.

FIG. 3 shows a section through a header box 15, in which the tube sheet 1 is made integrally with a cover part 16. The heat exchanger tubes 8 have been pressed into annular grooves 4 which are located in connection nozzles 3. The connection arrangement here corresponds to that described in detail with reference to FIGS. 1*a* to 1*c*.

Figure 4:
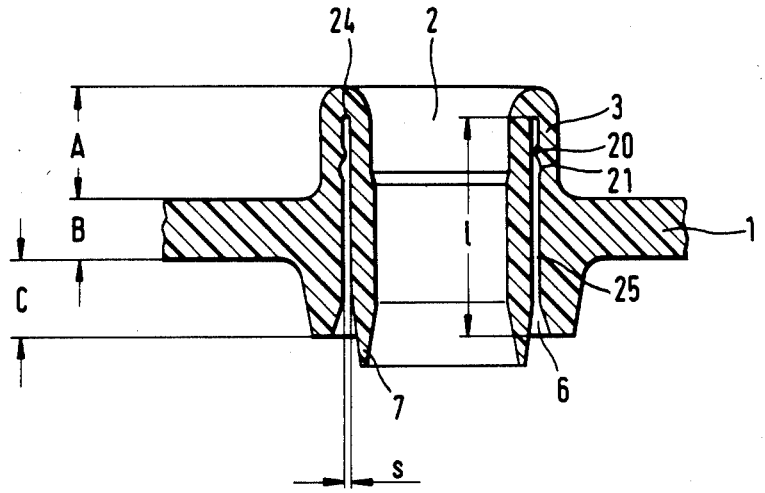
FIG. 4 shows an alternate embodiment similar to FIG. 1*a;*

FIG. 4 shows a detail of a tube sheet 1 which has an opening 2 for letting the heat exchange fluid pass through. The tube sheet 1 has a connection nozzle 3 which surrounds the opening 2 and has a middle section B, an end section A protruding into the interior of the header compartment and a section C located on the outside of the tube sheet 1. In the sleeve-shaped connection nozzle 3, there is an annular groove 25 which is arranged axially to the opening 2 and, starting from section C, extends as far as section A. In section A of the annular groove 25, a first curvature 20 is provided, which protrudes into the annular groove 25 and constricts the latter. The first curvature 20 is arranged at a defined distance from the bottom 24 of the annular groove 25. Immediately after the first curvature 20, in the direction of section B, there is a second curvature 21 in the annular groove 25, this second curvature 21 widening the annular groove. In other respects, the annular groove 25 is shaped such that its wall parts are cylindrical over the major part of the axial length, and a conical widening 6 is provided at the open end of the annular groove. The width of the annular groove 25 in the region of the cylindrical wall parts is marked s. The inner part of the end section C is provided with a cone 7 at its end. The depth of the annular groove 25 is marked 1.

Figure 5:
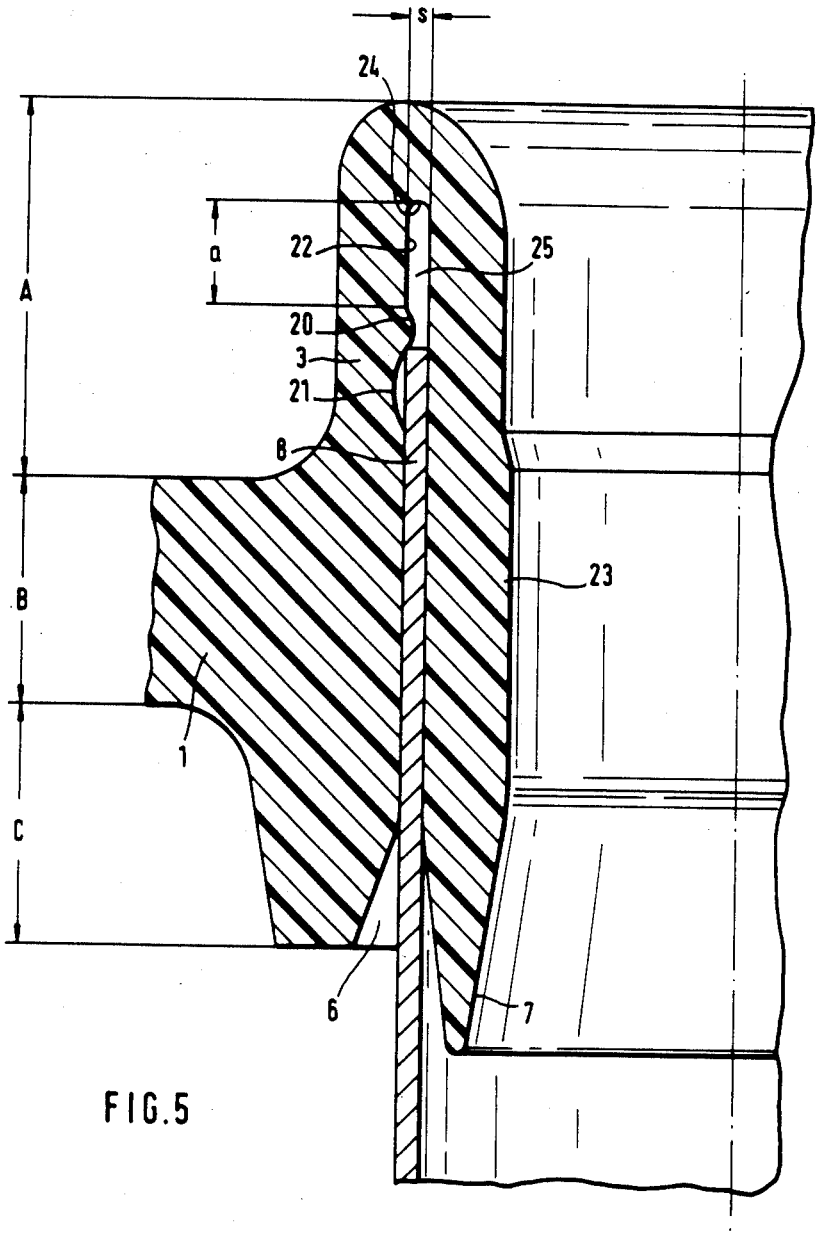
FIG. 5 shows an enlarged illustration of a part of FIG. 4, with a tube end pressed into the annular groove.

FIG. 5 shows a detail from FIG. 4 on an enlarged scale, with a tube end 8 pressed into the annular groove 25. The reference symbols used in FIG. 5 are the same for identical parts in FIG. 4. As can clearly be seen from FIG. 5, the tube end 8 is pressed into the annular groove 25 to such a depth that it bears against the curvature 20 which projects into the annular groove 25. Further penetration of the tube end 8 into the annular groove 25 would be possible only if the pressing-in force were substantially increased, and thus the inwardly-projecting curvature 20 effects an automatic "braking" of the tube end 8 during the pressing-in step. The curvature 21, which adjoins the inwardly-projecting curvature 20 and which widens the cross-section of the annular groove 25, at the same time reduces the material cross-section of that part of section A of the tube nozzle 3 which is located radially outside the annular groove 25. The result of this design is that, when a higher force is exerted by the tube end 8 on the curvature 20, a deformation of the plastic material takes place which prevents damage to the plastic material. As can also be seen from FIG. 5, the first curvature 20 is arranged at a distance "a" from the bottom 24 of the groove, the distance "a" being about five times the gap s of the annular groove 25. The distance "a" provides an adequate safety margin for preventing penetration of the tube end 8 down to the bottom 24 of the groove, even in the case of extreme tube length tolerances. For reasons of dimensional stability of that region of the tube nozzle 3 which is located radially inside the tube end 8 in section B, this region, over its entire length and partially also in section C, is made in such a way that part 23 of the connection nozzle has an at least approximately cylindrical increase in wall thickness.

FIG. 6 shows a detail of a tube sheet 1 which has an oval opening 31 for letting the heat exchange fluid pass through. The tube sheet 1 has a connection nozzle 34 which surrounds the opening 31 and in which an annular groove 32 is provided, the annular shape of which corresponds to the oval of the opening 31. A web 35 is provided in the direction of the short axis of the oval between parts 30, located radially on the inside, of the connection nozzle 34.

FIG. 7 shows a section along line II—II in FIG. 6. It can be seen from this illustration that the connection nozzle 34 of the tube sheet 1 comprises three sections, namely a middle section B, an end section A protruding into the interior of the header compartment, and an end section C located on the outside of the tube sheet 1. The annular groove 32, arranged axially to the opening 31, is located in the hill-shaped connection nozzle 34. The web 35, the upper and lower edges of which are each of flat shape, is arranged between the parts 30 of the connection nozzle 34 which are located radially on the inside. The web 35 is located in the region of the sections C and B, and it only slightly extends into the region of the end section A.

FIG. 8 shows a section taken along line III—III in FIG. 6, again illustrating the tube sheet 1, the oval opening 31 and the connection nozzle 34. This section in the direction of the long axis of the oval also cuts through the web 35, which is arranged in the middle of the long axis of the oval. As can also be seen from this illustration, the surfaces which face the flow direction of the fluid or face away from it are of flat shape—relative to the web thickness—but they could equally well be of curved or pointed shape.

If there are provided oval connection nozzles in which the ratio of short axis to long axis of the cross-sectional shape is not unduly large (for example, is about 1:2) or the radially inner section of the connection nozzle is very stiff, such support webs can be omitted.

FIG. 9 shows a detail of a tube sheet 1, which has an elongate opening 36 in the manner of a slot for letting the heat exchange fluid pass through. The tube sheet 1 has a connection nozzle 34 which surrounds the opening 36 and in which an annular groove 37 corresponding to the shape of the opening 36 is provided. Between radially inner parts 30 of the connection nozzle 34, three webs 38 are provided which extend in the direction of the short axis of the opening 36, that is to say transversely to the parallel wall parts of the connection nozzle 34. The inner wall surfaces of the connection nozzle 34 are marked 39. These wall surfaces 39 of the opening 36 are of concave shape between the webs 38 or between the narrow end and the adjacent web 38. This design of the wall parts 39 particularly enhances the dimensional stability of the plastic material in the connection nozzle.

FIG. 10 shows a section along line V—V in FIG. 9. The tube sheet 1 has a connection nozzle 34 for joining a flat tube (not shown in the drawing), the flat tube being pressed into the annular groove 37 in the connection nozzle 34. The opening 36 for letting the heat exchange fluid pass through is present in the connection nozzle 34. Between radially inner wall parts 30 of the connection nozzle 34, a web 38 is shown which supports the radially inner parts 30 of the connection nozzle 34 against each other. The web 38 is of flat shape on its side facing the end section A and has a concave curved shape on its side located in the end section C.

FIG. 11 shows a section along line VI—VI in FIG. 9. The opening 36 in the tube sheet 1 is here shown longitudinally with a section through the three webs 38.

In addition to the illustrative examples described above, further forms, for example, for rectangular tubes, are feasible.

What is claimed is:

1. A heat exchanger, comprising:

a tube sheet comprised of plastic and having at least one opening for passage of a heat exchange fluid; and a heat exchanger tube sealed against the tube sheet at said opening, wherein the tube sheet includes in the region of each of the opening a sleeve-like connection nozzle in which an annular groove is defined by inner and outer parts of said nozzle, said groove extending coaxially to the opening and being open toward the heat exchanger tube and into which the end of the heat exchanger tube is pressed, and wherein the sleeve-like connection nozzles have a middle section (B), which is located in the plane of the tube sheet, and end sections (A, C) which project on either side of the tube sheet.

2. A heat exchanger as claimed in claim 1, wherein

A=about 30% to 50%

B=about 20% to 35%, and

C=about 25% to 40% of the axial length of the connection nozzle.

3. A heat exchanger as claimed in claim 1, wherein the section C comprises a first part (C*), located radially inside the heat exchanger tube and a second part (C'), located radially outside the heat exchanger tube, and wherein said first part (C*) is longer than said second part (C').

4. A heat exchanger as claimed in claim 3, wherein the part (C*) comprises a cone at its distal end.

5. A heat exchanger as claimed in claim 1, wherein the depth of the annular groove is about 65% to 90% of the axial length of the connection nozzle.

6. A heat exchanger as claimed in claim 1, wherein the annular groove has cylindrical wall parts over almost its entire axial length.

7. A heat exchanger as claimed in claim 1, wherein the annular groove comprises a radial curvature on at least one of its wall parts.

8. A heat exchanger as claimed in claim 7, wherein the curvature projects into the annular groove and constricts the latter and is arranged in the end section (A) located on the side opposite the heat exchanger tube.

9. A heat exchanger as claimed in claim 8, wherein two curvatures are provided, comprising a first curvature which constricts the annular groove and is located nearer to the bottom of the groove than a second curvature which widens the annular groove.

10. A wall part as claimed in claim 9, wherein the first curvature is at a distance from the bottom of the groove which is at least three times the width of the annular groove.

11. A heat exchanger as claimed in claim 9, wherein the first and second curvatures are arranged on the same side of the wall part of the annular groove and lie immediately adjacent one another, in the axial direction.

12. A heat exchanger as claimed in claim 11, wherein the curvatures are located on the radially outer wall part of the annular groove.

13. A heat exchanger as claimed in claim 7, wherein the heat exchanger tube is pressed by radial deformation into the radial curvature of the annular groove.

14. A heat exchanger as claimed in claim 1, wherein the inner part of each connection nozzle comprises an at least approximately cylindrical increase in its wall thickness over the entire length of the middle section (B).

15. A heat exchanger as claimed in claim 1, wherein the annular groove includes a widening at the bottom of the groove.

16. A heat exchanger as claimed in claim 1, wherein the width of the annular groove is about 50% to 70% of the tube wall thickness.

17. A heat exchanger as claimed in claim 1, wherein each opening comprises an elongate cross-section having a longer and a shorter axis, and the shape of the annular groove corresponds to the cross-sectional shape of the opening, and further comprising at least one web extending essentially in the direction of the short axis between the radially inner parts of the connection nozzles.

18. A heat exchanger as claimed in claim 17, wherein each opening comprises a cross-sectional shape of a flat tube.

19. A heat exchanger as claimed in claim 18, wherein two or more of said webs are provided.

20. A heat exchanger as claimed in claim 19, wherein the inner wall surfaces of each opening defined at least in part by a web comprises a concave shape.

21. A heat exchanger as claimed in claim 20, wherein each opening in the tube sheet comprises the cross-sectional shape of an oval tube.

22. A heat exchanger as claimed in claim 17, wherein the web extends in the axial direction over about 50%–80% of the total length of the sections (A+B+C), and each web is located mainly in the middle section (B) and the section (C) located on the side of the tube sheet facing the tube.

23. A heat exchanger as claimed in claim 1, further comprising a header box formed integrally with the tube sheet.

* * * * *